US005277209A

United States Patent [19]

Olson

[11] Patent Number: 5,277,209

[45] Date of Patent: Jan. 11, 1994

[54] PUMPLESS PARTS WASHING APPARATUS

[76] Inventor: Gene R. Olson, 17939 W. Lincoln Ave., New Berlin, Wis. 53146

[21] Appl. No.: 894,918

[22] Filed: Jun. 8, 1992

[51] Int. Cl.[5] ..... B08B 3/02

[52] U.S. Cl. ..... 134/88; 134/198; 134/172; 134/201; 401/140; 4/602; 4/625; 239/377

[58] Field of Search ..... 134/88, 92, 117, 198, 134/200, 172, 180, 201; 222/166; 239/376, 377, 378; 220/4.12, 4.13, 4.20; 401/141, 142, 143, 146; 4/602, 603, 625, 626, 627

[56] References Cited

U.S. PATENT DOCUMENTS

| | | | |
|---|---|---|---|
| 12,340 | 1/1855 | Meacham | 401/203 |
| 75,311 | 3/1868 | Stankowitch | 4/626 |
| 597,529 | 1/1898 | Schulze | 4/637 |
| 664,791 | 12/1900 | Stow | 401/6 |
| 856,863 | 6/1907 | Grinder | 401/203 |
| 905,626 | 12/1908 | Armstrong | 239/377 |
| 957,566 | 5/1910 | Knickerbocker | 401/289 |
| 1,165,665 | 12/1915 | Grande | 134/92 |
| 1,592,709 | 7/1926 | Schwartz | 134/92 |
| 1,795,861 | 12/1926 | Johns | 401/289 |
| 2,171,972 | 9/1939 | Debor | 220/4.12 X |
| 2,666,668 | 1/1954 | Sieloff | 239/376 X |
| 3,280,828 | 10/1966 | Stiel | 134/117 |
| 3,284,838 | 11/1966 | Bieganowski | 401/289 |
| 3,388,823 | 6/1968 | Fleming et al. | 220/4.13 |
| 3,415,675 | 12/1968 | Allen | 401/289 |
| 3,453,665 | 7/1969 | Hager et al. | 4/625 |
| 4,357,240 | 11/1982 | Mehra et al. | 210/466 |

FOREIGN PATENT DOCUMENTS

| | | | |
|---|---|---|---|
| 144339 | 6/1901 | Fed. Rep. of Germany | 4/625 |
| 61-71022 | 4/1986 | Japan | 4/603 |
| 2235 | of 1911 | United Kingdom | 4/602 |
| 943042 | 11/1963 | United Kingdom | 4/627 |

*Primary Examiner*—Frankie L. Stinson
*Attorney, Agent, or Firm*—Joseph S. Heino

[57] ABSTRACT

A fluid dispensing apparatus is provided with at least two identically configured reservoirs, each of which may be functionally adapted to serve as the washer portion or the collecting portion of the apparatus.

8 Claims, 1 Drawing Sheet

FIG. 1.
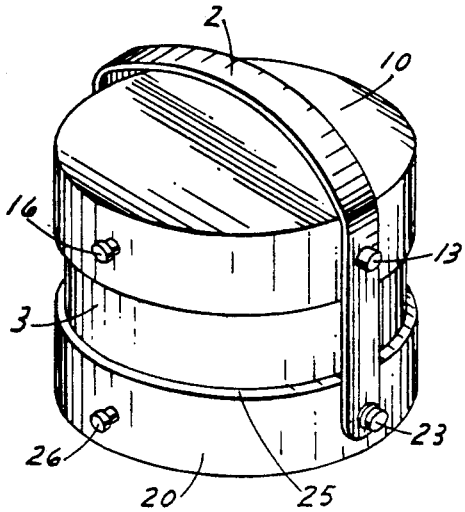
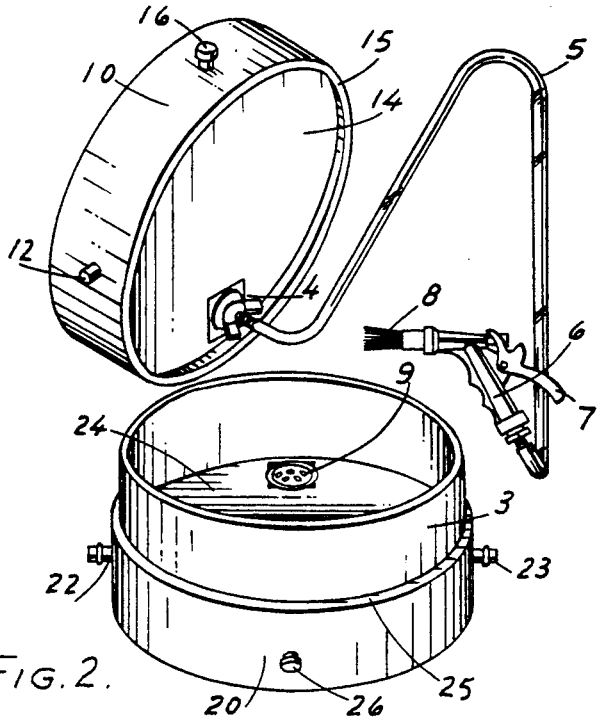
FIG. 2.
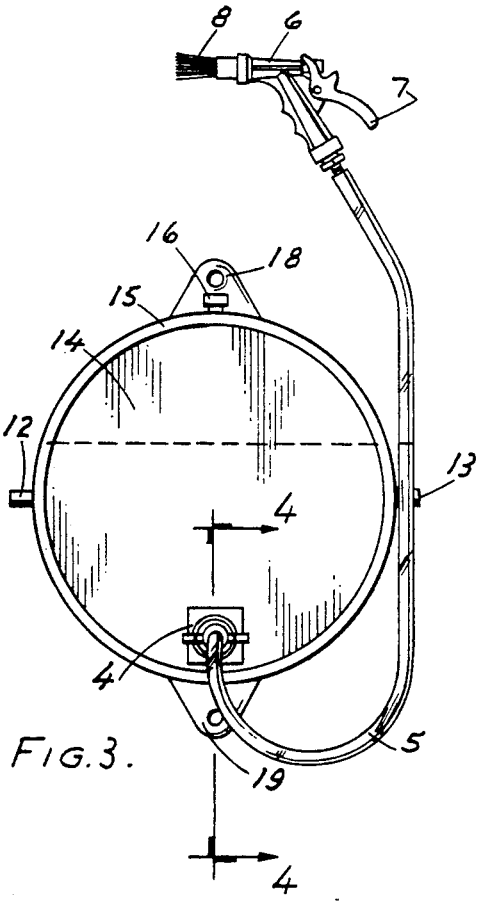
FIG. 3.
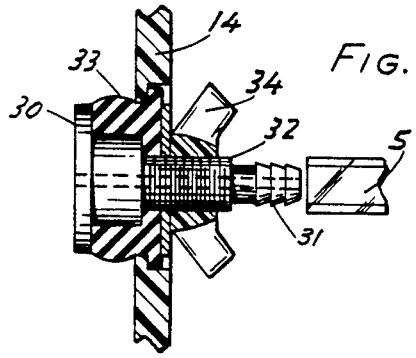
FIG. 4.
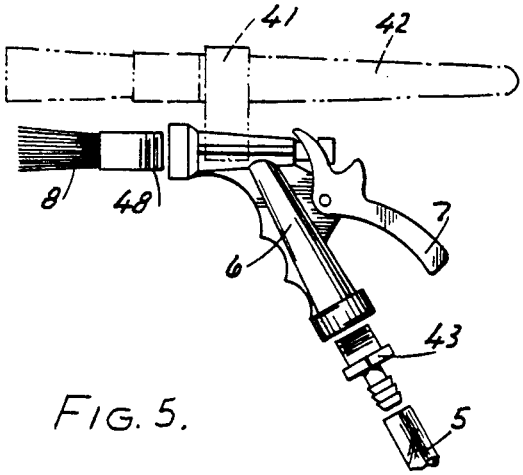
FIG. 5.

PUMPLESS PARTS WASHING APPARATUS

FIELD OF THE INVENTION

The present invention relates generally to devices for holding and dispensing fluids and the like and more particularly to a pumpless fluid dispensing apparatus for washing and cleaning machine tools and parts.

BACKGROUND OF THE INVENTION

The use of devices for dispensing cleaning solutions or fluids used in the washing and cleaning of machine tools and parts is well known. Such devices typically include a cleaning solution reservoir which pressurizes the cleaning solution by means of a pump. In this inventor's experience, such pumps are either air or electrically actuated and operated. The cleaning solution or fluid is discharged from the reservoir through a hose. The hose, in turn, is connected to a washing apparatus which is typically a nozzle, a spigot or a brush. The machine tools or parts can thereby be washed and cleaned by using the cleaning solution or fluid which passes through the washing apparatus.

In the experience of this inventor, disadvantages exist in the presently available systems. Among other things, such washers, for example, tend to use much more cleaning solution or fluid than is necessary to accomplish the job, require the use of a separate pressurizing device and are not readily portable. Additionally, the hazard of combining electricity and flammable cleaning solutions or fluids exists when electrically actuated and operated pumps are used.

SUMMARY OF THE INVENTION

It is, therefore, a principal object of this invention to provide a new, useful and uncomplicated parts washing apparatus which does not require a pump but which functions by utilizing the principles of gravity and atmospheric pressure. It is a further object to provide such an apparatus which provides for a minimal number of elements and which is easily and efficiently set up and used in the field. It is yet another object to provide such an apparatus which has reservoirs which can be interchangeably used as holders and suppliers of unused cleaning solution or fluid and as holders and collectors of used or contaminated cleaning solution or fluid.

The present invention has obtained these objects. It provides for at least two identically configured single port reservoirs. Each reservoir, when connected to a cleaning brush hose and cleaning brush, is functionally adapted to serve as the washer portion of the apparatus. Each reservoir, when used in combination with a protective washing shield and strainer, is functionally adapted to serve as the collecting and gathering portion of the apparatus. The foregoing and other features of the apparatus of the present invention will be further apparent from the description which follows.

BRIEF DESCRIPTION OF THE DRAWINGS

FIG. 1 is a perspective view of the parts washing apparatus of the present invention.

FIG. 2 is a second perspective view of one of the reservoirs of the apparatus shown in FIG. 1 and showing the reservoirs separated.

FIG. 3 is a front elevational view of one of the reservoirs of the apparatus shown in FIG. 1.

FIG. 4 is a cross-sectional view of a hose connector taken along line 4—4 in FIG. 3.

FIG. 5 is an elevational view of a cleaning brush handle and showing, in phantom view, a brush attachment means.

DETAILED DESCRIPTION

Referring now to the drawings in detail, FIG. 1 shows a parts washing apparatus constructed in accordance with the present invention. The washing apparatus includes a first container or reservoir 10 having a generally cylindrical configuration. The reservoir 10 has a back surface 12 and a front surface 14. About the perimeter of the front surface 14 of the reservoir 10 is a ridge 15. See FIG. 2. Also situated about the perimeter of the reservoir 10 are extension members 12,13 which are functionally adapted to be received by openings in a carrying handle or strap 2.

The front surface 14 of the reservoir 10 has a single port in it for receiving and retaining a pass-through plug 4. The plug 4 fits snugly within the port defined in the front surface 14. The plug 4 is connected to one end of a hose 5. Means for equalizing pressure within the reservoir 10 when fluid contained within the reservoir passes through the plug 4 and into the hose 5 is provided by a vent cap 16 at the perimeter of the reservoir 10, the reservoir 10 having no other opening in it.

The hose 5 is made of a clear flexible material and of sufficient length to enable the reservoir 10 to be placed remotely from the cleaning brush handle 6 which is attached to the other end of the hose 5. The cleaning brush handle 6 has brush bristles 8 situated at the discharge end of the handle 6 which are used to assist in the cleaning of parts or tools. The brush handle 6 is further provided with a spring loaded on/off switch or valve 7. The on/off valve 7 is used to permit or prohibit the flow of fluid through the brush handle 6 when such is desired or required.

The parts washing apparatus of the present invention also utilizes a second cylindrical reservoir 20, which is identical to the first reservoir 10, and has a front surface 24. This second reservoir 20 also has extension members 22,23 functionally adapted to be received by openings in the handle or strap 2. Situated about the perimeter of the front surface 24 of the second reservoir 20 is a ridge 25. Placed within the ridge 25 is a protective washing shield 3. The front surface 24 of the second reservoir 20 has a port defined in it for holding a strainer 9, the second reservoir 20 likewise having no other opening in it other than the vent cap 26 situated at its perimeter.

Because the reservoirs 10, 20 are identical and completely interchangeable, it is understood that the ridge 15 and port of the first reservoir 10 are functionally adapted to receive the protective washing shield 3 and the strainer 9, respectively. Likewise, the port of the second reservoir 20 is functionally adapted to receive the plug 4 and hose 5.

The reservoirs 10, 20 can also be provided with flat members 18, 19 extending from either side to assist in the handling or suspension of the reservoir 10. See FIG. 3. In the configuration shown, the amount of fluid retained within the reservoir may be determined when the clear hose 5 is held in horizontal relation to the reservoir.

In application, the carrying handle or strap 2 is removed from the extension members 12,13 and 22,23 to either side of the reservoirs 10,20, respectively. If it is not already, the first reservoir 10 is filled with cleaning solution through the port located in the front surface 14. The plug 4 is, in the preferred embodiment, constructed such that it has a flanged inner surface 30 which protrudes into the reservoir front surface 14. About the plug's inner core 32 is an oversized resilient compression gasket 33. At the outer end of the plug is a wing nut 34 which, when tightened, pulls the plug flange 30 and gasket 33 into sealing engagement with the reservoir. See FIG. 4.

The reservoir 10 is elevated sufficiently to allow gravity and atmospheric pressure to effect a flow of the cleaning solution through the hose 5 when the brush handle valve 7 is actuated. Parts can then be washed in the basin formed by the top surface 24 of the second reservoir 20 and the shield 3 situated within the ridge 25 thereof. The contaminated cleaning solution then passes through the port contained in the top surface 24 of the second reservoir 20 and through the strainer 9 place therein.

From the foregoing detailed description of the illustrated embodiment of the invention set forth herein, it will be apparent that there has been provided a new, useful and uncomplicated pumpless parts washing apparatus which has two identically configured reservoirs which can be interchangeably used as holders and suppliers of unused cleaning solution and as holders and collectors of used or contaminated cleaning solution, which does not require a pump but rather functions by utilizing the principles of gravity and atmospheric pressure and which is easily and efficiently set up and used in the field.

The principles of this invention having been fully explained in connection with the foregoing, I hereby claim as my invention:

1. A fluid dispensing apparatus for washing and cleaning machine tools and parts, including a first reservoir means, said first reservoir means comprising a cylindrical body member having a flat front surface and a flat back surface, said flat front surface having a ridge defined about the perimeter thereof, a second reservoir means, said second reservoir means comprising a second cylindrical body substantially identical to said first cylinder body, means for dispensing fluid contained within said first and second cylindrical body members, means for collecting fluid within said first and second cylindrical body members, and means for equalizing pressure within said first and second cylindrical body members.

2. The apparatus of claim 1 wherein said fluid dispensing means includes an opening defined in the front face of said cylindrical body, a plug insertable into said opening and a hose and nozzle means connected to said plug.

3. The apparatus of claim 2 wherein said fluid collecting means includes a cylinder concentrically insertable within the front surface ridge of said cylindrical body members and a removable strainer insertable into said front surface opening.

4. The apparatus of claim 3 wherein said plug and said strainer are interchangeable within said front surface opening.

5. A pumpless fluid dispensing apparatus for washing and cleaning machine tools and parts comprising at least two identically configured portable containers each having a hollow interior defining a fluid reservoir therewithin, means for dispensing fluid contained within said container reservoir, said fluid dispensing means including a pressure equalizing means and further including an opening defined atop one side of each of said portable containers, a plug insertable into said opening and a hose and nozzle means connected to said plug, and means for collecting fluid within said fluid reservoir.

6. A pumpless fluid dispensing apparatus for washing and cleaning machine tools and parts comprising at least two portable containers each having a hollow interior defining a fluid reservoir therewithin, means for dispensing fluid contained within said container reservoir, said fluid dispensing means including a pressure equalizing means and further including an opening defined atop one side of each of said portable containers, a plug insertable into said opening and a hose and nozzle means connected to said plug, and means for collecting fluid within said fluid reservoir, said fluid collecting means including means for forming a basin atop one side of each of said portable containers.

7. The apparatus of claim 6 wherein said fluid collecting means further includes a removable strainer insertable into said container opening.

8. The apparatus of claim 7 wherein said plug and said strainer are interchangeable within said front surface opening.

* * * * *